United States Patent [19]

Berger

[11] Patent Number: 4,986,667

[45] Date of Patent: Jan. 22, 1991

[54] SELF CLEANING APPARATUS FOR PREPARING AQUEOUS AIR FOAMS

[75] Inventor: Thomas W. Berger, Roseville, Minn.

[73] Assignee: Minnesota Mining and Manufacturing Company, St. Paul, Minn.

[21] Appl. No.: 370,687

[22] Filed: Jun. 23, 1989

[51] Int. Cl.[5] ..... B01F 5/04

[52] U.S. Cl. ..... 366/173; 239/113; 239/427.5; 239/432

[58] Field of Search ..... 366/3, 10, 106, 150, 366/154, 162, 165, 167, 173, 174, 176, 177, 262, 336, 337, 340; 422/111, 257; 239/113, 143, 145, 427.3, 427.5, 432

[56] References Cited

U.S. PATENT DOCUMENTS

| | | | |
|---|---|---|---|
| 553,915 | 2/1896 | Karch | 239/113 |
| 2,143,817 | 1/1939 | Longdin et al. | 239/427.5 |
| 3,388,868 | 6/1968 | Watson et al. | 239/432 |
| 3,430,865 | 3/1969 | McDougall | 239/427.5 |
| 4,086,663 | 4/1978 | Croft | 366/154 |
| 4,107,075 | 8/1978 | Kramer | 252/359 |
| 4,213,936 | 7/1980 | Lodrick | 422/133 |
| 4,519,338 | 5/1985 | Kramer et al. | 118/305 |
| 4,795,764 | 1/1989 | Alm et al. | 521/107 |

FOREIGN PATENT DOCUMENTS

| | | | |
|---|---|---|---|
| 1209357 | 8/1986 | Canada . | |
| 83239 | 8/1957 | Sweden | 239/432 |
| 1074731 | 2/1984 | U.S.S.R. | 366/10 |

*Primary Examiner*—Robert W. Jenkins

*Attorney, Agent, or Firm*—Donald M. Sell; Walter N. Kirn; James D. Christoff

[57] ABSTRACT

An apparatus for preparing a water-based air foam includes a mixing chamber for mixing two liquid components, and a nozzle which sprays the mixed liquid components toward a pair of screens within a compartment to produce a foam material. A portion of the first liquid component is diverted upstream of the mixing chamber and is sprayed by three nozzles into the compartment to continously wash away pre-gelled materials which might otherwise accumulate on a side wall surrounding the compartment.

8 Claims, 1 Drawing Sheet

SELF CLEANING APPARATUS FOR PREPARING AQUEOUS AIR FOAMS

BACKGROUND OF THE INVENTION

1. Field of the Invention

This invention relates to apparatus for mixing liquid components with air to form a foam material.

2. Description of the Related Art

Sanitary landfill operators typically cover each day's deposit of garbage with a layer of compacted earth to reduce, among other things, the escape of odors and blowing paper, the proliferation of flies and rodents and excessive leaching of hazardous components from the garbage. The daily earth cover, often about six inches deep, is somewhat expensive to apply due to the use of heavy equipment. The earth cover also occupies a significant volume of the landfill which might otherwise be used for receiving garbage and thus such an earth cover reduces the useful life of the landfill.

Recently, increased interest has been directed toward the use of foamed synthetic materials for covering waste. Typically, such materials are sprayed on the garbage to provide a blanket that, when covered with the next layer of garbage, compresses to occupy relatively little volume. U.S. Pat. Nos. 4,421,788 and 4,519,338, both assigned to the assignee of the present invention, describe apparatus which may be used for applying a foam layer over large areas of landfill in a relatively short time.

An improved foam for landfills is described in U.S. Pat. No. 4,795,764 which is also assigned to the assignee of the present invention. This foam is prepared by mixing aqueous solution of a water-soluble or water-dispersible organic solvent solution of aliphatic isocyanate-terminated prepolymer with an aqueous solution comprising polyamine gelling agent and foaming agents, and incorporating air into this mixture to form a fluid, water-based air foam which is then sprayed onto the exposed surface of a landfill or other substrate. Within a short time period thereafter (for example, within 30 to 60 seconds), the fluid foam gels or stabilizes. Conventionally, the two liquid components of this foam material are mixed in a mixing chamber and then sprayed toward a screen that is located in a compartment. Compressed air is also introduced into the compartment, and the air and mixed liquid materials combine to form the foam material at the screen. The foam material is then discharged through a flattened spreader tip in a fan-shaped pattern.

It has been observed, however, that some pre-gelling of the foam may occur over time on the compartment walls, causing a gradual build-up which eventually restricts the flow of materials through the compartment. Moreover, the gelled materials are occasionally dislodged from the walls and collect on the screen, thus requiring disassembly of the mixing apparatus to unclog the screen. Such a procedure is time consuming and inconvenient.

SUMMARY OF THE INVENTION

The present invention is directed toward an apparatus for preparing foam materials, and includes a first piping means for connection with a source of a first liquid component of a foam material along with a second piping means for connection with a source of a second liquid component of a foam material. A mixing chamber is connected to the first piping means and the second piping means for mixing the first liquid component and the second liquid component. The apparatus also includes a housing having walls defining an internal compartment and an outlet opening, and partition means extending across the outlet opening and having a multiplicity of orifices. A nozzle is connected to the chamber and the housing for spraying mixed materials from the chamber into the compartment and toward the orifices. A passageway is connected to the first piping means and includes a port adjacent the walls of the housing for discharging a portion of the first liquid component onto the walls.

As a result, the walls of the compartment are continuously rinsed with a portion of the first liquid component and gradual build-up of gelled materials on the walls is largely avoided. Moreover, the use of the first liquid component as a rinse does not adversely affect reaction stoichiometry of the two components.

DESCRIPTION OF THE PREFERRED EMBODIMENT

Figure 1:
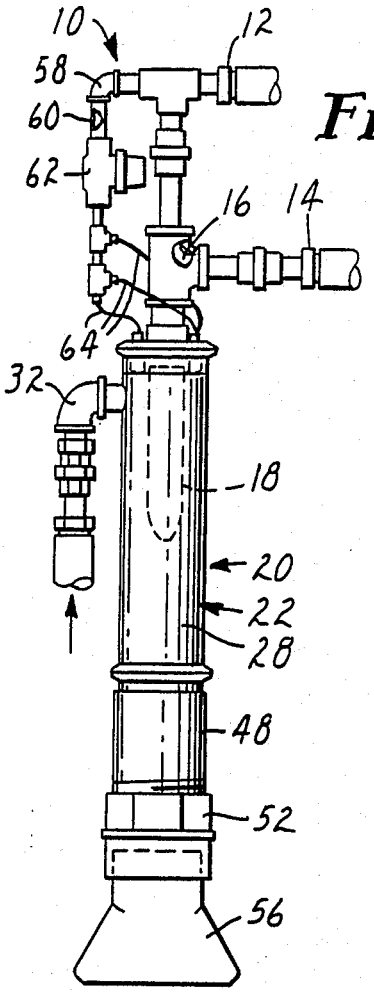
FIG. 1 is a fragmentary, side elevational view of an apparatus constructed in accordance with the present invention.
Figure 2:
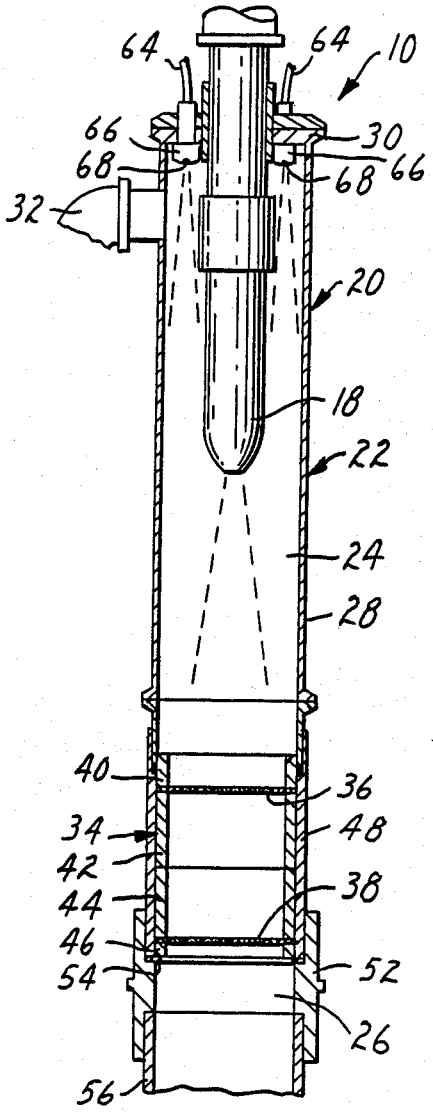
FIG. 2 is an enlarged, fragmentary, side cross-sectional view of the apparatus shown in FIG. 1.
Figure 3:
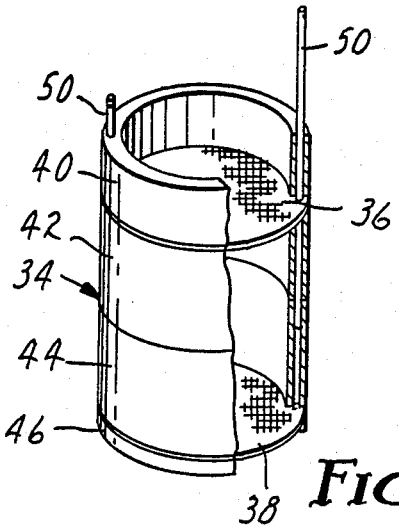
FIG. 3 is an enlarged, perspective view with parts broken away in section of a screen assembly of the apparatus shown in FIGS. 1 and 2.

An apparatus 10 for preparing foam materials is shown in FIGS. 1–3. Referring initially to FIG. 1, the apparatus 10 includes a first piping means 12 for connection with a source of a first liquid component of a foam material, and a second piping means 14 for connection with a source of a second liquid component of a foam material.

Representative first and second liquid components of the foam material are described in the aforementioned U.S. Pat. No. 4,795,764 which is expressly incorporated by reference herein. As an example, the first liquid component may be an aqueous solution of polyamine gelling agent and foaming agents, while the second liquid component may be an organic solvent solution of aliphatic isocyanate-terminated prepolymer dissolved or dispersed in water. In practice, both components are typically made by mixing concentrated solutions of the respective components with water at locations upstream of the corresponding first piping means 12 and second piping means 14.

The first and second liquid components are mixed in a mixing chamber 16 that is connected to and located downstream of the first piping means 12 and the second piping means 14. The mixing chamber 16 is coupled to a nozzle 18 that discharges the mixed components in a conical spray pattern.

A housing 20 surrounds a lower portion of the mixing chamber 16 and has walls 22 which define an internal compartment 24 (FIG. 2) and an outlet opening 26. The housing walls 22 comprise a cylindrical side wall 28, and an end 30 which is opposed to the outlet opening 26. A pipe 32 is connected to a source of compressed air and is connected to the side wall 28 adjacent the end 30 and upstream of the terminal or outlet end of the nozzle 18.

A partition means 34 having a multiplicity of orifices extends across the outlet opening 26 and comprises two screens 36,38 which are illustrated in FIGS. 2 and 3. The screens 36,38 are held in place between ring sections 40,42,44,46 to form a screen assembly that fits within a surrounding tube 48 (FIG. 2). A pair of guide rods 50 (FIG. 3) extend through the assembly to align the sections 40,42,44,46 to the screens 36,38.

The tube 48 is fixed at its upper end to the side wall 28 and is threaded at its lower end into a female adapter 52 which includes an inner shoulder 54 for holding the screen assembly in place. The adapter 52 is secured at its lower end to a flattened spreader tip 56 (FIG. 1) which discharges the foam materials formed on the screens 36,38 in a fan-shaped pattern.

A pipe assembly 58 as illustrated in FIG. 1 is connected to the first piping means 12 and has a passageway 60 for continuously diverting a portion of the flow of the first liquid component that would otherwise flow to the mixing chamber 16. The assembly 58 includes a filter 62 and terminates in three sections of tubing 64 that lead to respective spray nozzles 66. The three nozzles 66 are connected to the end 30 between the larger nozzle 18 and the cylindrical side wall 28 and are spaced equidistantly apart, i.e., approximately 120 degrees apart around the nozzle 18.

Each of the nozzles 66 has a port 68 for discharging a portion of the first liquid component onto the side wall 28 for continuously rinsing away pre-gelled foam materials that might otherwise accumulate on the side wall 28. In use, the first component that is discharged from the ports 68 travels along the side wall 28 and then mixes with the conical spray of mixed first and second components that is discharged from the nozzle 18 in a direction toward the screens 36,38. The foam is formed at the screens 36,38 and then is discharged through the spreader tip 56 to a desired substrate such as the exposed surface of a landfill.

In practice, it has been found that satisfactory results may be obtained when approximately five to fifteen percent of the total first liquid component flow is diverted into the passageway 60 from the first piping means 12 while the ratio of the flows of the total first liquid component and the second liquid component is approximately 1:1.

What is claimed is:

1. An apparatus for preparing foam materials comprising:

first piping means for connection with a source of a first liquid component of a foam material;

second piping means for connection with a source of a second liquid component of a foam material;

a mixing chamber connected to said first piping means and said second piping means for mixing said first liquid component and said second liquid component;

a housing having walls defining an internal compartment and an outlet opening;

partition means extending across said outlet opening and having a multiplicity of orifices;

a nozzle coupled to said chamber and said housing for spraying mixed materials from said chamber into said compartment and toward said orifices;

a passageway connected to said first piping means and including a port adjacent said walls of said housing for continuously discharging a portion of said first liquid component onto said walls;

a source of pressurized air; and means for introducing said air into said compartment.

2. The apparatus of claim 1, wherein said port and said nozzle are side-by-side and are positioned to discharge respective liquid components in the same general direction.

3. The apparatus of claim 2, wherein said passageway includes a plurality of additional ports spaced around said nozzle.

4. The apparatus of claim 1, wherein said compartment is generally cylindrical.

5. The apparatus claim 4, wherein said nozzle is operable to spray a generally conical pattern.

6. The apparatus of claim 1, wherein said partition means comprises one or more screens.

7. The apparatus of claim 1, wherein said housing walls include a sidewall, and an end opposed to said partition means, wherein said nozzle protrudes through said end and is spaced from said sidewall, and wherein said port is located adjacent said end between said nozzle and said sidewall.

8. The apparatus of claim 1, wherein said means for introducing said air into said compartment comprises a pipe.

* * * * *